US011168875B2

(12) United States Patent
Hou et al.

(10) Patent No.: US 11,168,875 B2
(45) Date of Patent: Nov. 9, 2021

(54) DOWNLIGHT APPARATUS

(71) Applicant: XIAMEN ECO LIGHTING CO. LTD., Xiamen (CN)

(72) Inventors: Shouqiang Hou, Xiamen (CN); Jinfu Chen, Xiamen (CN); Xiaoliang Wen, Xiamen (CN); Yongzhe Dong, Xiamen (CN)

(73) Assignee: XIAMEN ECO LIGHTING CO. LTD., Fujian (CN)

( * ) Notice: Subject to any disclaimer, the term of this patent is extended or adjusted under 35 U.S.C. 154(b) by 0 days.

(21) Appl. No.: 16/852,471

(22) Filed: Apr. 18, 2020

(65) Prior Publication Data

US 2021/0063003 A1 Mar. 4, 2021

(30) Foreign Application Priority Data

| | | |
|---|---|---|
| Aug. 30, 2019 | (CN) | 201910815426.5 |
| Aug. 30, 2019 | (CN) | 201921436960.7 |
| Aug. 30, 2019 | (CN) | 201921437646.0 |
| Aug. 30, 2019 | (CN) | 201921437706.9 |

(51) Int. Cl.

| | |
|---|---|
| ***F21V 21/30*** | (2006.01) |
| ***F21V 15/01*** | (2006.01) |
| ***F21V 31/00*** | (2006.01) |
| *F21Y 115/10* | (2016.01) |

(52) U.S. Cl.

CPC ..... *F21V 21/30* (2013.01); *F21V 15/012* (2013.01); *F21V 31/005* (2013.01); *F21Y 2115/10* (2016.08)

(58) Field of Classification Search

CPC ..... F21S 8/026; F21V 14/02; F21V 14/06; F21V 15/012; F21V 21/30

See application file for complete search history.

(56) References Cited

U.S. PATENT DOCUMENTS

| | | | | |
|---|---|---|---|---|
| 5,738,436 | A * | 4/1998 | Cummings | F21S 2/00 362/294 |
| 9,182,093 | B2 * | 11/2015 | Santiago | F21K 9/20 |
| 9,447,953 | B2 * | 9/2016 | Lawlor | F21V 21/14 |
| 9,523,493 | B2 * | 12/2016 | Chen | F21V 1/00 |
| 10,697,599 | B1 * | 6/2020 | Davis | F21K 9/69 |
| 10,851,971 | B1 * | 12/2020 | Huang | F21V 31/005 |
| 10,900,648 | B2 * | 1/2021 | Zeng | F21V 14/06 |
| 2002/0145871 | A1 * | 10/2002 | Yoda | B60Q 3/44 362/241 |

(Continued)

*Primary Examiner* — Leah Simone Macchiarolo
(74) *Attorney, Agent, or Firm* — Chun-Ming Shih; Lanway IPR Services

(57) ABSTRACT

A downlight apparatus includes a rotation housing, a spherical housing, a light source and an elastic structure. The rotation housing has a spherical inner surface and a bottom opening. The spherical housing has a spherical outer surface corresponding to the spherical inner surface. The elastic structure presses the spherical housing to engage the rotation housing applying an elastic force to keep the spherical housing to stay at an engaged position with respect to the rotation housing. When an external force is applied to the spherical housing to deform the elastic structure, the spherical housing is escaped from the engaged position and rotatable with respect to the rotation housing until another engaged position is determined by releasing the external force.

19 Claims, 11 Drawing Sheets

(56) References Cited

U.S. PATENT DOCUMENTS

| | | | | |
|---|---|---|---|---|
| 2003/0081422 | A1* | 5/2003 | Ward | F21V 21/30 362/428 |
| 2007/0091602 | A1* | 4/2007 | van Voorst Vader | G03B 15/05 362/244 |
| 2013/0182417 | A1* | 7/2013 | Amat Girbau | F21V 21/02 362/147 |
| 2017/0343190 | A1* | 11/2017 | Georgiev | F21V 17/02 |
| 2019/0022263 | A1* | 1/2019 | Quilici | H05B 47/105 |
| 2020/0132278 | A1* | 4/2020 | Portinga | F21V 7/04 |
| 2020/0224857 | A1* | 7/2020 | Liang | F21V 21/40 |
| 2020/0326053 | A1* | 10/2020 | Hou | F21V 21/40 |
| 2020/0393119 | A1* | 12/2020 | Portinga | F21V 14/04 |

* cited by examiner

DOWNLIGHT APPARATUS

FIELD

The present application is related to a downlight apparatus and more particularly related to a downlight apparatus with flexible light direction.

BACKGROUND

Electroluminescence, an optical and electrical phenomenon, was discover in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

Downlight devices are widely used in various places, e.g. office, factory, home. Sometimes, people only need downlight devices to emit light providing general luminance. In some other cases, people may want the downlight devices to emit lights to focus on certain objects or areas. It is therefore important to design a flexible downlight device with capability for changing light directions and patterns conveniently.

SUMMARY

In some embodiments, a downlight apparatus includes a rotation housing, a spherical housing, a light source and an elastic structure.

The rotation housing has a spherical inner surface and a bottom opening.

The spherical housing has a spherical outer surface corresponding to the spherical inner surface.

The light source is disposed to a holder of the spherical housing. The holder is located inside the spherical housing. For example, the holder is an installation surface inside the spherical housing for installing the light source with positioning a fixing structure. The light source emits light through the bottom opening of the rotation housing.

The elastic structure presses the spherical housing to engage the rotation housing applying an elastic force to keep the spherical housing to stay at an engaged position with respect to the rotation housing. When an external force is applied to the spherical housing to deform the elastic structure, the spherical housing is escaped from the engaged position and rotatable with respect to the rotation housing until another engaged position is determined by releasing the external force.

Specifically, the elastic structure, e.g. a spring or multiple elastic clips, for applying a force to the spherical housing to engage at one or multiple positions of the rotation housing. When an external force, e.g. a pressing of a user on the spherical housing, the external force disconnects the engagement between the rotation housing and the spherical housing so that the spherical housing is rotatable inside the spherical inner surface. When a desired light output angle is determined, the user releases the external force, the elastic structure then continues to press the spherical housing to engage the rotation housing at a new engaged position.

The spherical inner surface, the spherical outer surface may not be a complete sphere shape. A partial sphere shape, e.g. half ball surface or two-third half ball surface may be examples of the spherical inner surface and the spherical outer surface mentioned here.

The rotation housing has a top cover and a bottom cover. A first inner surface of the top cover and a second inner surface of the bottom cover together form the spherical inner surface. The bottom cover has a surface rim defining the bottom opening.

Specifically, in such embodiments, the rotation housing is made by two units. The two units together form a partially spherical container space for containing the spherical housing and allows the spherical housing to be rotated inside the container space.

In some embodiments, the top cover is detachable from the bottom cover for changing another bottom cover with another surface rim with a different shape as the original surface rim.

In some embodiments, the rotation housing has an anti-sliding structure for engaging the spherical housing to keep the spherical housing at the engaged position.

In some embodiments, the spherical housing has a top unit and a bottom unit, the top unit is connected to the bottom unit with the elastic structure, when the external force is applied to the bottom unit, the bottom unit is moved with respect to the top unit for rotating inside the spherical inner surface.

In some embodiments, the top unit has a water proof ring sealing a contact area between the top unit and the bottom unit with interference fit.

An interference fit, also known as a press fit or friction fit is a form of fastening between two tight fitting mating parts that produces a joint which is held together by friction after the parts are pushed together.

Depending on the amount of interference, parts may be joined using a tap from a hammer or pressed together using a hydraulic ram. Critical components that must not sustain damage during joining may also be frozen to shrink one of the components before fitting. This method allows the components to be joined without force and producing a shrink fit interference when the component returns to normal temperature. Interference fits are commonly used with fasteners to induce compressive stress around holes to improve the fatigue life of a joint.

The tightness of fit is controlled by amount of interference; the allowance (planned difference from nominal size). Formulas exist to compute allowance that will result in various strengths of fit such as loose fit, light interference fit, and interference fit. The value of the allowance depends on which material is being used, how big the parts are, and what degree of tightness is desired. Such values have already been worked out in the past for many standard applications, and they are available to engineers in the form of tables, obviating the need for re-derivation.

As an example, a 10 mm (0.394 in) shaft made of 303 stainless steel will form a tight fit with allowance of 3-10 μm (0.00012-0.00039 in). A slip fit can be formed when the bore diameter is 12-20 μm (0.00047-0.00079 in) wider than the rod; or, if the rod is made 12-20 μm under the given bore diameter. [citation needed]

An example: The allowance per inch of diameter usually ranges from 0.001 to 0.0025 inches (0.0254 to 0.0635 mm) (0.1-0.25%), 0.0015 inches (0.0381 mm) (0.15%) being a fair average. Ordinarily the allowance per inch decreases as the diameter increases; thus the total allowance for a diameter of 2 inches (50.8 mm) might be 0.004 inches (0.1016 mm), 0.2%), whereas for a diameter of 8 inches (203.2 mm) the total allowance might not be over 0.009 or 0.010 inches (0.2286 or 0.2540 mm) i.e., 0.11-0.12%). The parts to be assembled by forced fits are usually made cylindrical, although sometimes they are slightly tapered. Advantages of the taper form are: the possibility of abrasion of the fitted surfaces is reduced; less pressure is required in assembling; and parts are more readily separated when renewal is required. On the other hand, the taper fit is less reliable, because if it loosens, the entire fit is free with but little axial movement. Some lubricant, such as white lead and lard oil mixed to the consistency of paint, should be applied to the pin and bore before assembling, to reduce the tendency toward abrasion.

There are two basic methods for assembling an oversize shaft into an undersized hole, sometimes used in combination: force and thermal expansion or contraction.

There are at least three different terms used to describe an interference fit created via force: press fit, friction fit, and hydraulic dilation.

Press fit is achieved with presses that can press the parts together with very large amounts of force. The presses are generally hydraulic, although small hand-operated presses (such as arbor presses) may operate by means of the mechanical advantage supplied by a jackscrew or by a gear reduction driving a rack and pinion. The amount of force applied in hydraulic presses may be anything from a few pounds for the tiniest parts to hundreds of tons for the largest parts.

Often the edges of shafts and holes are chamfered (beveled). The chamfer forms a guide for the pressing movement, helping to distribute the force evenly around the circumference of the hole, to allow the compression to occur gradually instead of all at once, thus helping the pressing operation to be smoother, to be more easily controlled, and to require less power (less force at any one instant of time), and to assist in aligning the shaft parallel with the hole it is being pressed into. In the case of train wheelsets the wheels are pressed onto the axles by force.

Most materials expand when heated and shrink when cooled. Enveloping parts are heated (e.g., with torches or gas ovens) and assembled into position while hot, then allowed to cool and contract back to their former size, except for the compression that results from each interfering with the other. This is also referred to as shrink-fitting. Railroad axles, wheels, and tires are typically assembled in this way. Alternatively, the enveloped part may be cooled before assembly such that it slides easily into its mating part. Upon warming, it expands and interferes. Cooling is often preferable as it is less likely than heating to change material properties, e.g., assembling a hardened gear onto a shaft, where the risk exists of heating the gear too much and drawing its temper.

In some embodiments, the elastic structure is a spring with a first end fixed to the top unit and a second end fixed to the bottom unit.

In some embodiments, the bottom unit is made of a heat dissipation material. For example, the bottom unit is made of metal. The metal bottom unit efficiently carries away heat generated by the light source to keep the light source working in a proper temperature environment.

In some embodiments, the top unit is made of heat dissipation material for guiding heat of the light source outside the rotation housing.

The top unit engages the bottom unit and thus further transmits heat quickly away from the light source.

In some embodiments, the spherical housing has a cover connector for selecting a lens cover for generating a light beam by the light source or a diffusion cover for generating a diffused light by the light source.

The spherical housing may be installed with a reflector cup for reflecting light of the light source effectively moving though the bottom opening.

In addition, there may be a cover connector for detachably attaching one of multiple types of lens cover. For example, a lens cover with multiple condensing lens may help generate a focused light beam. A lens cover with diffusion material may help diffuse light of the light source to generate a soft light pattern.

In some embodiments, the lens cover provides multiple emphasizing light beams.

The light cover may have multiple condensing lens for generating more than one light beams.

This is helpful when more than one objects needed to be emphasized by the downlight apparatus.

In some embodiments, the downlight apparatus may also include a driver, wherein when the lens cover and the diffusion cover is installed to the cover connector, the driver selects a corresponding setting to control the light source according to a cover type provided by the cover connector.

The driver automatically detects the type of the installed lens cover and controls the light source according to the lens cover type. For example, when a lens cover for generating two focused light beams, the driver turns on two sets of LED modules of the light source corresponding to the two focused light beams. When the installed lens cover is a night light type diffusion cover, the driver lowers the luminance of the light source automatically according to the installed lens cover type.

In some embodiments, the downlight apparatus may also include a light cover for passing the light of the light source, wherein the light cover has a rotatable lens for changing a direction of a light beam generated from the light of the light source.

In addition to rotation between the rotation housing and the spherical housing, a lens cover may also be disposed with another rotation structure, e.g. a rotating axis with a focus lens for further adjusting a light beam direction of the light source.

In some embodiments, the downlight apparatus may also include a driver box, the driver box has a wire connector for connecting to a wire connected to the light source and extended from spherical housing.

In some embodiments, there is a manual switch disposed on the driver box for configuring a setting for a driver on how to control the light source.

In some embodiments, the light source has multiple types of LED modules for mixing a color temperature defined by the manual switch.

In some embodiments, the rotation structure has a top cover with a top opening allowing the wire to pass through.

In some embodiments, the downlight apparatus may also include a distance detector electrically connected to the driver for detecting a distance between the light source and the projected surface for changing a light beam angle of the light source according the detected distance.

In some embodiments, the driver box contains a wireless module for receiving an external command, the external command is considered together with an operation of the manual switch to determine how to control the light source.

The wireless module may be made as a detachable module. The detachable module may be inserted to a slot of the driver box to enhance function of the driver box. The driver co-works with the plugged wireless module to provide remote control function. On the other hand, if people do not need such ruction, they simply buy the driver box without the wireless module with lower price.

In some embodiments, the driver box contains a driver automatically detects a parameter of the light source and translates an operation of the manual switch based on the detected parameter of the light source.

DETAILED DESCRIPTION

Figure 1:
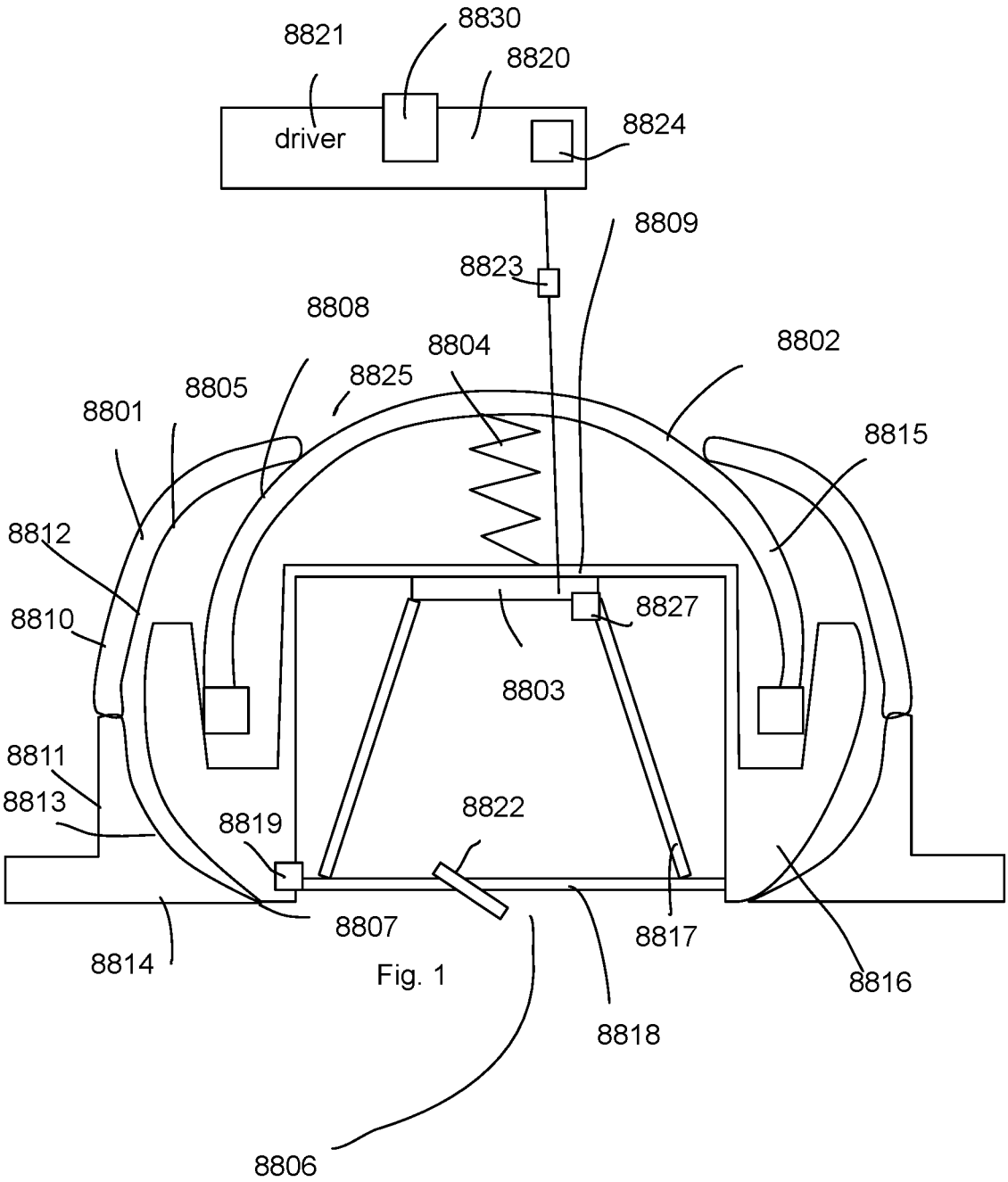
FIG. 1 illustrates a downlight apparatus embodiment.

In FIG. 1, a downlight apparatus includes a rotation housing 8801, a spherical housing 8802, a light source 8803 and an elastic structure 8804.

The rotation housing 8801 has a spherical inner surface 8805 and a bottom opening 8806.

The spherical housing 8802 has a spherical outer surface 8808 corresponding to the spherical inner surface 8805.

The light source 8803 is disposed to a holder 8809 of the spherical housing 8802. The holder 8809 is located inside the spherical housing 8802. For example, the holder 8809 is an installation surface inside the spherical housing 8809 for installing the light source 8803 with positioning a fixing structure. The light source 8803 emits light through the bottom opening 8806 of the rotation housing 8801.

The elastic structure 8804 presses the spherical housing 8802 to engage the rotation housing 8801 by applying an elastic force to keep the spherical housing 8802 to stay at an engaged position 8807 with respect to the rotation housing 8801. When an external force is applied to the spherical housing 8802 to deform the elastic structure 8804, the spherical housing 8802 is escaped from the engaged position 8807 and rotatable with respect to the rotation housing 8801 until another engaged position is determined by releasing the external force.

Specifically, the elastic structure, e.g. a spring or multiple elastic clips for applying a force to the spherical housing to engage at one or multiple positions of the rotation housing. When an external force, e.g. a pressing of a user on the spherical housing, the external force disconnects the engagement between the rotation housing and the spherical housing so that the spherical housing is rotatable inside the spherical inner surface. When a desired light output angle is determined, the user releases the external force, the elastic structure then continues to press the spherical housing to engage the rotation housing at a new engaged position.

The spherical inner surface, the spherical outer surface may not be a complete sphere shape. A partial sphere shape, e.g. half ball surface or two-third half ball surface may be examples of the spherical inner surface and the spherical outer surface mentioned here.

The rotation housing 8801 has a top cover 8810 and a bottom cover 8811. A first inner surface 8812 of the top cover 8810 and a second inner surface 8813 of the bottom cover 8811 together form the spherical inner surface 8812. The bottom cover 8811 has a surface rim 8814 defining the bottom opening 8806.

Specifically, in such embodiments, the rotation housing is made by two units. The two units together form a partially spherical container space for containing the spherical housing and allows the spherical housing to be rotated inside the container space.

In FIG. 1, the spherical housing 8802 has a top unit 8815 and a bottom unit 8816.

For example, the bottom unit 8816 is made of metal. The metal bottom unit efficiently carries away heat generated by the light source 8803 to keep the light source 8803 working in a proper temperature environment.

The top unit 8815 engages the bottom unit 8816 and thus further transmits heat quickly away from the light source 8803.

The spherical housing 8802 may be installed with a reflector cup 8817 for reflecting light of the light source 8803 effectively moving though the bottom opening 8806.

In addition, there may be a cover connector 8819 for detachably attaching one of multiple types of lens cover. For example, a lens cover with multiple condensing lens may help generate a focused light beam. A lens cover with diffusion material may help diffuse light of the light source to generate a soft light pattern.

In some embodiments, the bottom unit 8816 is made of a heat dissipation material.

For example, the bottom unit 8816 is made of metal. The metal bottom unit efficiently carries away heat generated by the light source 8803 to keep the light source 8803 working in a proper temperature environment.

In some embodiments, the top unit 8815 is made of heat dissipation material for guiding heat of the light source 8803 outside the rotation housing.

The top unit 8815 engages the bottom unit 8816 and thus further transmits heat quickly away from the light source 8803.

In some embodiments, the lens cover provides multiple emphasizing light beams. For example, the light source is divided into three sets and each set are positioned and correspond to a condensing lens for forming three lights of the three sets to three light beams.

The light cover may have multiple condensing lens for generating more than one light beams.

This is helpful when more than one objects needed to be emphasized by the downlight apparatus.

In some embodiments, the downlight apparatus may also include a driver 8821, wherein when the lens cover and the diffusion cover is installed to the cover connector 8819, the driver 8821 selects a corresponding setting to control the light source according to a cover type provided by the cover connector 8807.

For example each type of lens cover has an electronic or structure identifier. When the lens cover is connected to the cover connector 8819, the electronic or structure identifier is converted and/or transmitted as a corresponding electronic message to the driver 8821. The driver 8821 checks the identifier and determines a corresponding way to drive the light source.

The driver automatically detects the type of the installed lens cover and controls the light source according to the lens cover type. For example, when a lens cover for generating two focused light beams, the driver turns on two sets of LED modules of the light source corresponding to the two focused light beams. When the installed lens cover is a night light type diffusion cover, the driver lowers the luminance of the light source automatically according to the installed lens cover type.

In FIG. 1, the downlight apparatus may also include a light cover for passing the light of the light source, wherein the light cover 8818 has a rotatable lens 8822 for changing a direction of a light beam generated from the light of the light source 8803.

In addition to rotation between the rotation housing and the spherical housing, a lens cover may also be disposed with another rotation structure, e.g. a rotating axis with a focus lens for further adjusting a light beam direction of the light source.

In some embodiments, the downlight apparatus may also include a driver box 8820, the driver box 8820 has a wire connector 8823 for connecting to a wire connected to the light source 8803 and extended from spherical housing 8802.

In FIG. 1, there is a manual switch 8824 disposed on the driver box 8820 for configuring a setting for a driver 8821 on how to control the light source 8803.

In some embodiments, the light source has multiple types of LED modules for mixing a color temperature defined by the manual switch.

In some embodiments, the rotation structure 8801 has a top cover with a top opening 8825 allowing the wire to pass through.

In some embodiments, the downlight apparatus may also include a distance detector 8827 electrically connected to the driver 8821 for detecting a distance between the light 8803 source and the projected surface for changing a light beam angle of the light source 8803 according the detected distance. For example, the distance detector 8827 is a radar or a laser detector for calculating a distance between the lighting apparatus and a projected surface. When the detected distance is sent to the driver 8821, parameters like a corresponding luminance level and/or a portion of LED modules of the light source 8803 being turned on/off, are determined by the driver 8821 and provides corresponding operation to achieve a desired effect. For example, the projected luminance area may be fixed no matter how tall the ceiling for installing the downlight apparatus from a table to be projected. When the distance is larger, a higher luminance level is set for the light source. less LED modules, e.g. LED modules located at the central part of the light source, may be turned on to keep the focus area within desired range.

In some embodiments, the driver box 8820 contains a wireless module 8830 for receiving an external command, the external command is considered together with an operation of the manual switch to determine how to control the light source.

The wireless module may be made as a detachable module. The detachable module may be inserted to a slot of the driver box to enhance function of the driver box. The driver co-works with the plugged wireless module to provide remote control function. On the other hand, if people do not need such ruction, they simply buy the driver box without the wireless module with lower price.

In some embodiments, the driver box contains a driver automatically detects a parameter of the light source and translates an operation of the manual switch based on the detected parameter of the light source.

For example, multiple types of the light source may be installed to the same downlight structure as mentioned above. Some light source may have LED modules with multiple color temperatures to mix a desired color temperature while some other light source may have LED modules with multiple colors for mixing a desired color. Other configuration may be changed for different light source. The driver may check a type identifier provided by the light source and selects a corresponding setting to operate the light source. In addition, the same manual switch may have different meanings for activating different function when different types of light source are installed.

Figure 2:
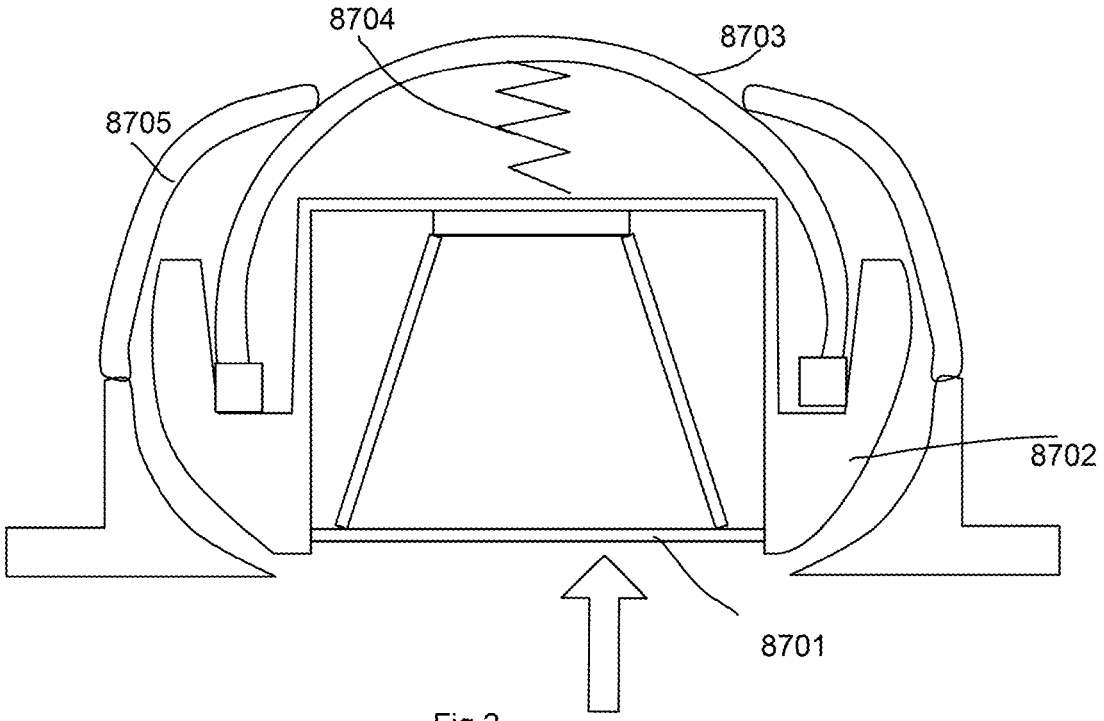
FIG. 2 illustrates another status of the embodiment in FIG. 1.

In FIG. 2, the spherical housing 8701 of the embodiment in FIG. 1 is pressed with an external force. The bottom unit 8702 is moved with respect to the top unit 8703 by deforming the spring 8704. In such status, the bottom unit 8701 leaves contact with the rotation housing 8705 and may be rotated easily to a new desired position to change light direction of the light source.

Figure 3:
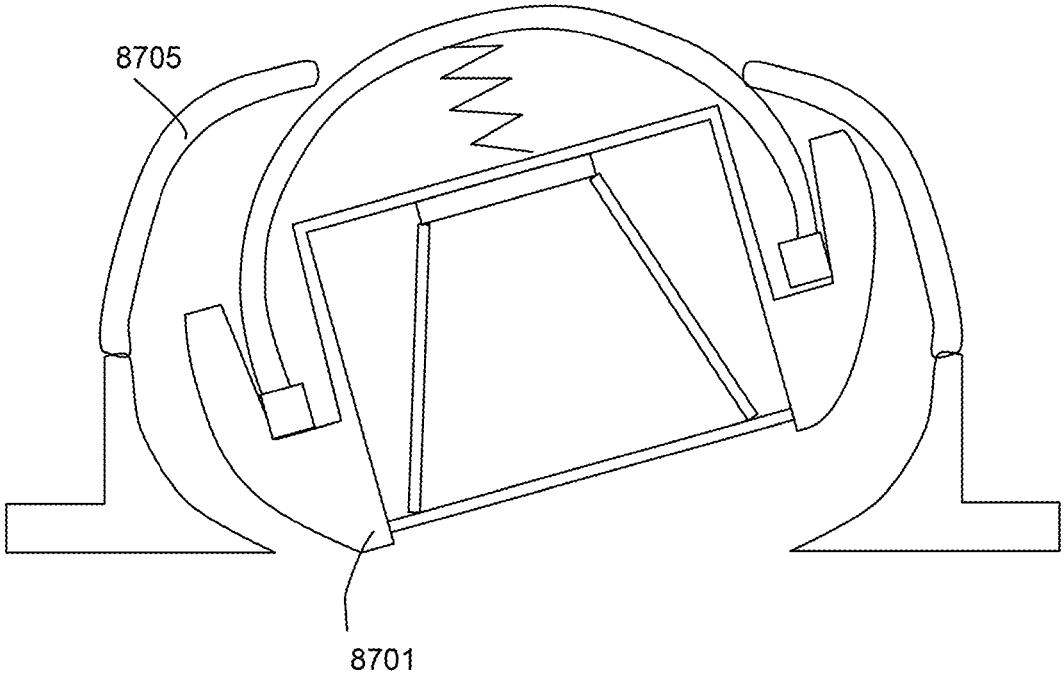
FIG. 3 illustrates another status of the embodiment in FIG. 1.

FIG. 3 shows a rotation of the spherical housing 8701 with respect to the rotation housing 8705.

Figure 4:
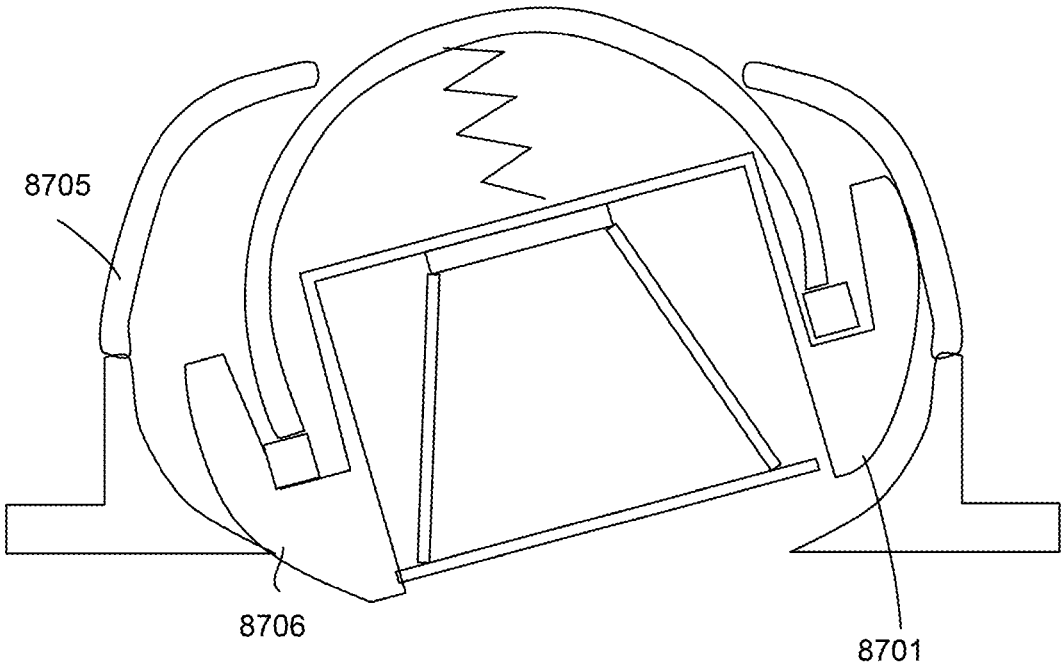
FIG. 4 illustrates another status of the embodiment in FIG. 1.

FIG. 4 shows when the external force is released, the spherical housing 8701 continues to engage the rotation housing 8705 to keep at a new engaging position 8706.

Figure 5:
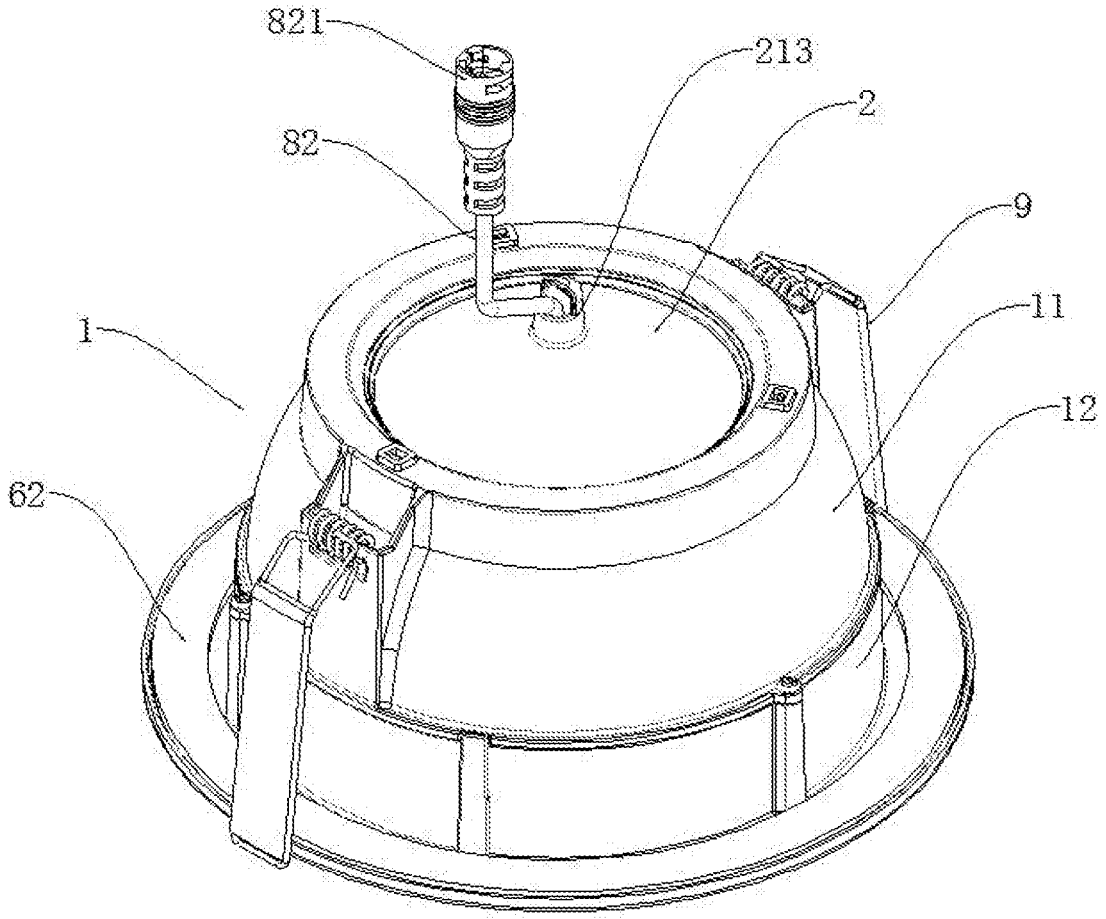
FIG. 5 illustrates another detail embodiment.

In FIG. 5, a downlight apparatus 1 is disclosed. The downlight apparatus 1 has a surface rim 62, a connecting wire 82, and a wire connector 821 for connecting to a driver.

There is an opening 213 allowing the connecting wire 82 to enter a spherical housing 2. There two elastic springs 9 to keep the downlight apparatus 1 staying in an installation hole or an installation box. The spherical housing 2 is rotated with respect to a rotation housing 11. There is a side wall 12 for enhancing heat dissipation.

Figure 6:
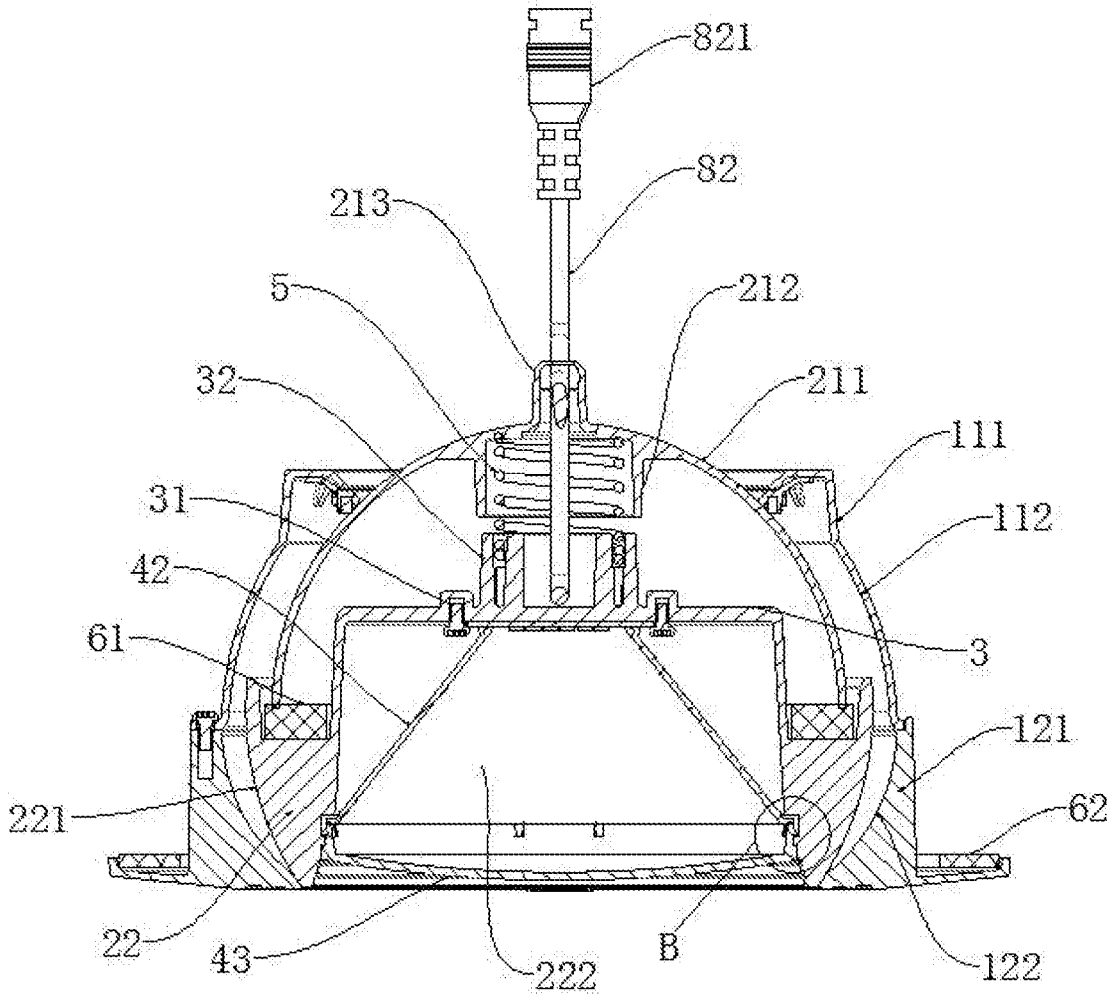
FIG. 6 illustrates a cross-section view of the embodiment in FIG. 5.

In FIG. 6, more components in the embodiment of FIG. 5 are illustrated. The same reference numerals as FIG. 5 refer to the same components.

In FIG. 6, there is a spring 5 installed in a container 212. The top unit 211 and the bottom unit 221 may be moved by deforming the spring 5. There are screws 31 for fixing the light source plate. The bottom unit 21 may be a heat sink 3 made of metal material. There is a wire box 32 for connecting wires to the light source. A reflective cup 42 helps increase light efficiency. There is a sealing ring 61 for preventing water or dust entering the downlight apparatus. There is a heat sink block 22 in the bottom unit 221. A lens cover 43 is installed for guiding light in the container space outside the downlight apparatus. The rotation housing 11 defines a spherical inner surface 122. The bottom cover 121 also helps heat dissipation if being made of metal material. The top cover 111 of the rotation housing is also curved to form a portion of the spherical inner surface 112.

Figure 7:
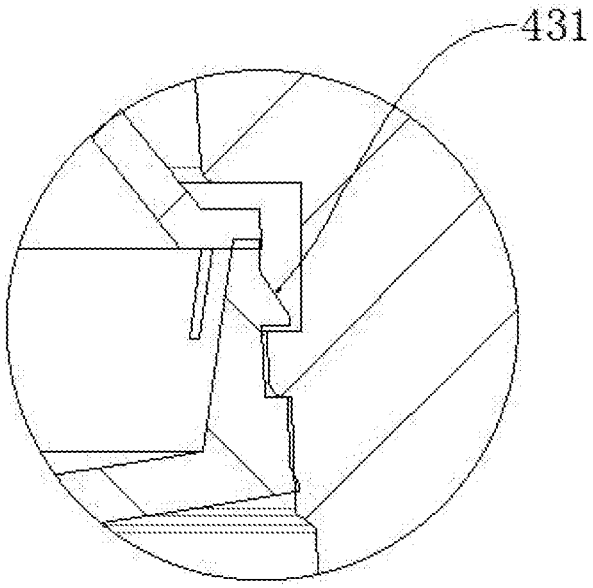
FIG. 7 illustrates a component of the embodiment in FIG. 5.

FIG. 7 shows a connection structure 431 in the position marked B in FIG. 6. Such connection structure simplifies assembling of components of the downlight apparatus.

Figure 8:
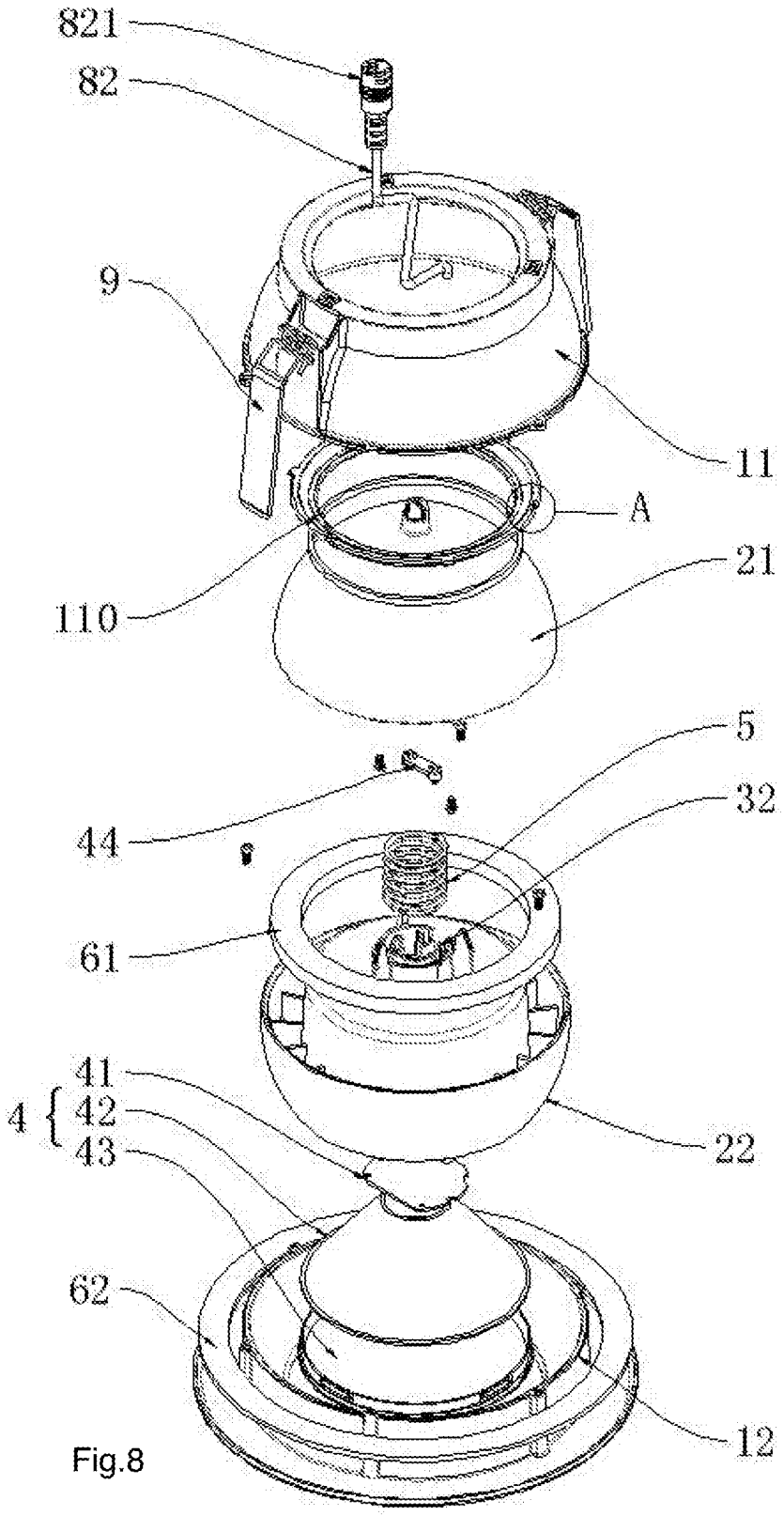
FIG. 8 illustrates an exploded view of the embodiment in FIG. 5.

FIG. 8 shows an exploded diagram that may be referenced together with FIG. 6. The same reference numerals refer to the same components and are not repeated here for brevity.

In FIG. 8, the optical component 4 includes a light source 41, a reflective cup 42 and a lens cover 43. The wire 82 is pressed by a wire plate 44. The fixing hole 32 is used for fixing the spring 5.

Figure 9:
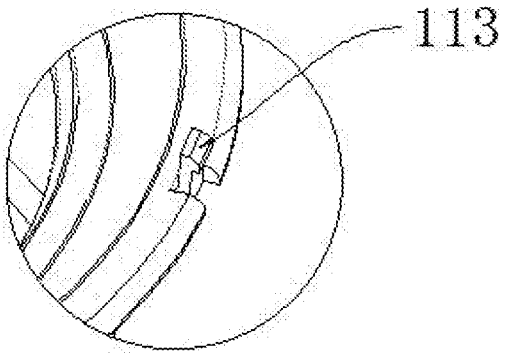
FIG. 9 illustrates a component.

In FIG. 9, a buckle structure 113 is shown for connecting components.

Figure 10:
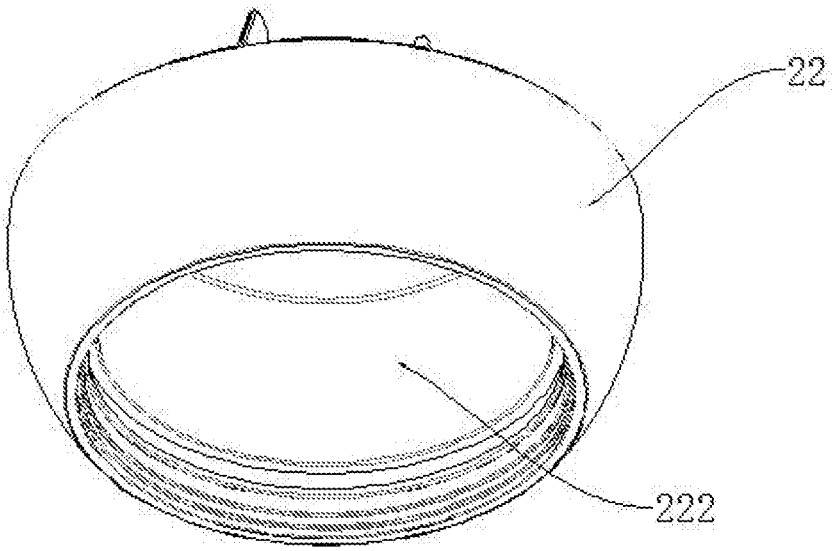
FIG. 10 illustrates another component.

In FIG. 10, the heat sink block 22 has a heat sink space 222.

Figure 11:
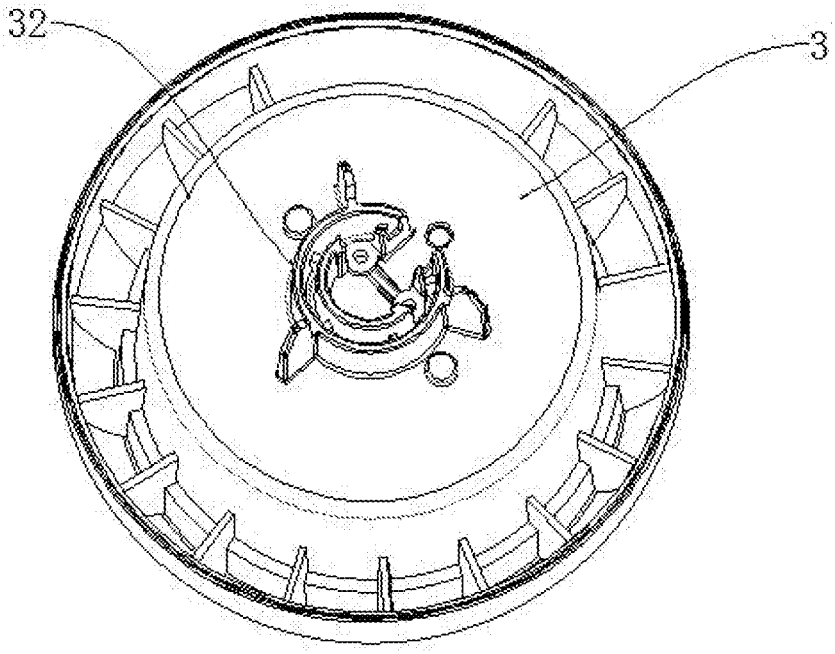
FIG. 11 illustrates another component.

In FIG. 11, the top cover 3 provides a fixing part 32 for fixing a wire.

Figure 12:
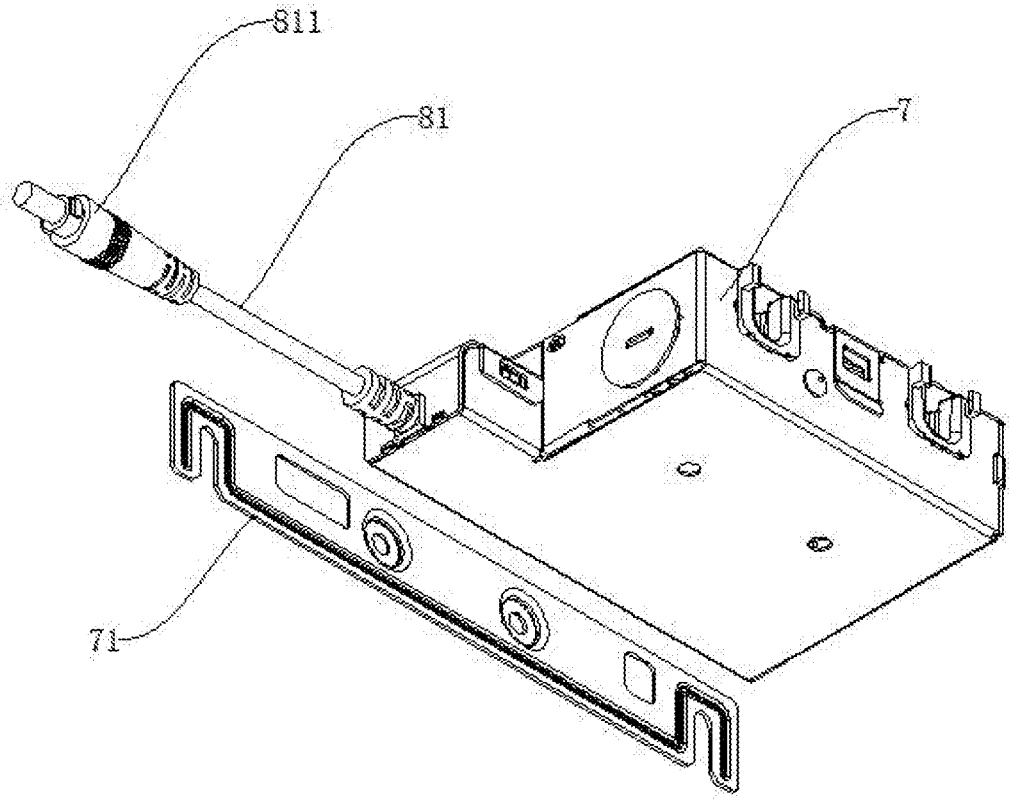
FIG. 12 illustrates a driver box.

In FIG. 12, a driver box 7 has a wire 81 connected to a wire connector 811. A side cover 71 is provided for easily plugging additional module.

The wire connecting to the down light apparatus may be bent with a bent structure installed on the top unit of the spherical housing. Specifically, the wire is bent with an angle by the bent structure so as to prevent falling away while being pulled accidently.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a rotation housing having a spherical inner surface and a bottom opening;

a spherical housing having a spherical outer surface corresponding to the spherical inner surface;

a light source disposed to a holder of the spherical housing, the holder being located inside the spherical housing, the light source emitting light through the bottom opening of the rotation housing; and an elastic structure pressing the spherical housing to engage the rotation housing applying an elastic force to keep the spherical housing to stay at an engaged position with respect to the rotation housing, where when an external force is applied to the spherical housing to deform the elastic structure, the spherical housing is escaped from the engaged position and rotatable with respect to the rotation housing until another engaged position is determined by releasing the external force, wherein the spherical housing has a top unit and a bottom unit, the top unit is connected to the bottom unit with the elastic structure, when the external force is applied to the bottom unit, the bottom unit is moved with respect to the top unit for rotating inside the spherical inner surface.

2. The downlight apparatus of claim 1, wherein the rotation housing has a top cover and a bottom cover, a first inner surface of the top cover and a second inner surface of the bottom cover together form the spherical inner surface, the bottom cover has a surface rim defining the bottom opening.

3. The downlight apparatus of claim 2, wherein the top cover is detachable from the bottom cover for changing another bottom cover with another surface rim with a different shape as the original surface rim.

4. The downlight apparatus of claim 2, wherein the rotation housing has an anti-sliding structure for engaging the spherical housing to keep the spherical housing at the engaged position.

5. The downlight apparatus of claim 1, wherein the top unit has a water proof ring sealing a contact area between the top unit and the bottom unit.

6. The downlight apparatus of claim 1, wherein the elastic structure is a spring with a first end fixed to the top unit and a second end fixed to the bottom unit.

7. The downlight apparatus of claim 1, wherein the bottom unit is made of a heat dissipation material.

8. The downlight apparatus of claim 1, wherein the top unit is made of heat dissipation material for guiding heat of the light source outside the rotation housing.

9. The downlight apparatus of claim 1, wherein the spherical housing has a cover connector for selecting a lens cover for generating a light beam by the light source or a diffusion cover for generating a diffused light by the light source.

10. The downlight apparatus of claim 9, wherein the lens cover provides multiple emphasizing light beams.

11. The downlight apparatus of claim 9, further comprising a driver, wherein when the lens cover and the diffusion cover is installed to the cover connector, the driver selects a corresponding setting to control the light source according to a cover type provided by the cover connector.

12. The downlight apparatus of claim 1, further comprising a light cover for passing the light of the light source, wherein the light cover has a rotatable lens for changing a direction of a light beam generated from the light of the light source.

13. The downlight apparatus of claim 1, further comprising a driver box, the driver box has a wire connector for connecting to a wire connected to the light source and extended from spherical housing.

14. The downlight apparatus of claim 13, wherein there is a manual switch disposed on the driver box for configuring a setting for a driver on how to control the light source.

15. The downlight apparatus of claim 14, wherein the light source has multiple types of LED modules for mixing a color temperature defined by the manual switch.

16. The downlight apparatus of claim 14, wherein the rotation housing has a top cover with a top opening allowing the wire to pass through.

17. The downlight apparatus of claim 14, further comprising a distance detector electrically connected to the driver for detecting a distance between the light source and the projected surface for changing a light beam angle of the light source according the detected distance.

18. The downlight apparatus of claim 14, wherein the driver box contains a wireless module for receiving an external command, the external command is considered together with an operation of the manual switch to determine how to control the light source.

19. The downlight apparatus of claim 14, wherein the driver box contains a driver automatically detects a parameter of the light source and translates an operation of the manual switch based on the detected parameter of the light source.

* * * * *